US005672843A

United States Patent [19]

Evans et al.

[11] Patent Number: 5,672,843

[45] Date of Patent: Sep. 30, 1997

[54] SINGLE CHARGE PYROTECHNIC

[75] Inventors: John Harold Evans, Harleysville; Michael Albert Lehmicke, Havertown, both of Pa.

[73] Assignee: ICI Americas Inc.

[21] Appl. No.: 318,466

[22] Filed: Oct. 5, 1994

[51] Int. Cl.[6] ..... C06D 5/06; C06B 33/06

[52] U.S. Cl. ..... 102/289; 102/290; 102/202.7; 149/42; 149/109.2

[58] Field of Search ..... 102/289, 290, 102/202.7; 149/35, 42, 109.2

[56] References Cited

U.S. PATENT DOCUMENTS

| | | | |
|---|---|---|---|
| 3,122,462 | 2/1964 | Kaufman et al. | 149/35 |
| 3,797,854 | 3/1974 | Poole et al. | 280/150 AB |
| 4,484,960 | 11/1984 | Rucker | 149/22 |
| 4,806,180 | 2/1989 | Goetz et al. | 149/5 |
| 4,858,951 | 8/1989 | Lenzen | 280/741 |
| 5,005,486 | 4/1991 | Lenzen | 102/531 |
| 5,140,906 | 8/1992 | Little, II | 102/202.14 |
| 5,230,287 | 7/1993 | Arrell, Jr. et al. | 102/202.5 |
| 5,403,036 | 4/1995 | Zakula et al. | 280/741 |
| 5,404,813 | 4/1995 | Wong | 102/289 |

*Primary Examiner*—Peter A. Nelson

[57] ABSTRACT

A single charge pyrotechnic material comprising a metal fuel, an oxidizer and a secondary fuel which can be used to control the rate of reaction of the pyrotechnic. The composition can be used as a single charge igniter in an automotive air bag system in place of the separate ignition charge and enhancer charge currently utilized.

16 Claims, 1 Drawing Sheet

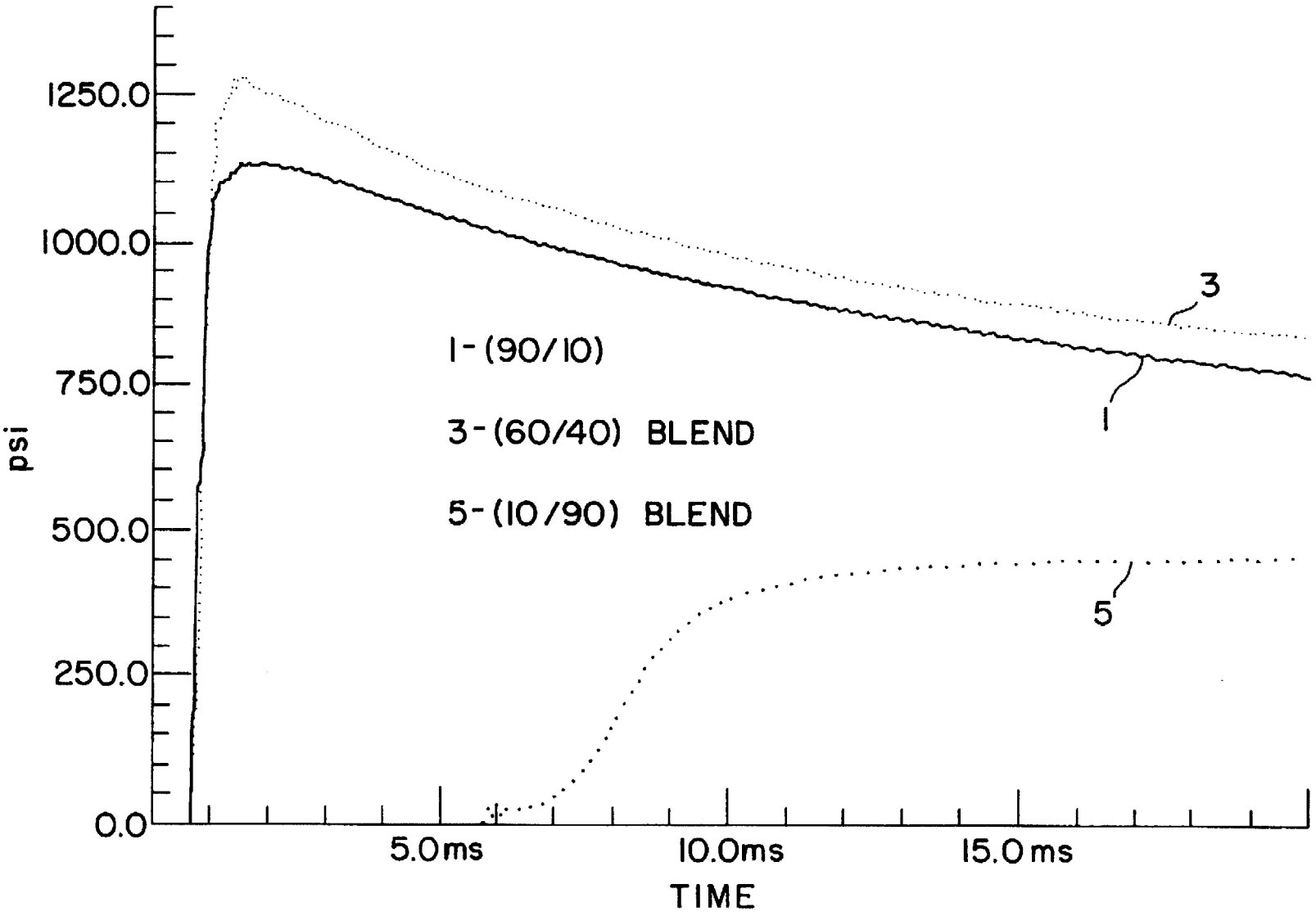
1250.0
1000.0
750.0
500.0
250.0
0.0
psi
5.0ms
10.0ms
15.0ms
TIME
1-(90/10)
3-(60/40) BLEND
5-(10/90) BLEND
1
3
5

SINGLE CHARGE PYROTECHNIC

FIELD OF THE INVENTION

The present invention is directed to pyrotechnic materials, and in particular, to the substitution of a single charge pyrotechnic composition for a multiple charge pyrotechnic composition.

DESCRIPTION OF THE RELATED ART

Pyrotechnic initiation used in air bag technology employs multiple charges of various pyrotechnic compositions which are ignited in series and which finally ignite a final pyrotechnic charge and/or propellant. Generally, the final propellant in this pyrotechnic sequence generates most of the gas used to inflate the air bag. Problems associated with this arrangement are generally related to the complexity of manufacturing the series of pyrotechnic charges prior to the propellant charge. This series, generally termed as an air bag igniter and enhancer, thus comprises multiple pyrotechnic charges.

Multiple pyrotechnic charges or compositions are used to modulate the gas generant rate of the propellant. As those skilled in this art may appreciate, pyrotechnic compositions, generally, are very fast reacting chemical combinations. For use in air bags, these combinations must be fast reacting to ensure that an inflated air bag first contacts the occupants of an in-the-act accident rather than other interior portions of the automobile. However, as with the majority of uses in the pyrotechnics art, control of the reaction timing is very important. For example, too fast a pyrotechnic reaction may result in insufficient heat transfer and thus failure to release the gas from the final pyrotechnic and/or propellant. This would result in an uninflated air bag.

Similarly, too slow a reaction will result in the air bag being insufficiently filled when needed.

Typically, the chemical charge section of an air bag propellant system consists of three separate charges. Two of these three components, designated herein as the ignition charge and an enhancer charge, are used in combination to provide an igniter component which initiates the third component of the air be; propellant, namely the final pyrotechnic material. This final pyrotechnic material is generally a flame sensitive material which will generate a relatively large amount of gas. Suitable materials include, for example, various azide materials, and in particular, sodium azide, which, when initiated, provides most of (if not all of) the gas used to inflate the air bag.

Prior art ignition charges generally comprise a mixture of zirconium (or titanium) and potassium perchlorate, located within an ignition charge container. This ignition charge is initiated by a bridge wire which is also located within the ignition charge container. Generally, only several hundred milligrams of the ignition charge are utilized in these prior art devices.

The initiation of the ignition charge causes the initiation of an operatively adjacent enhancer charge, which typically comprises a mixture of boron and potassium nitrate, and which is held within an enhancer charge container. Generally several grams of the enhancer charge are utilized in order to effect initiation of the final pyrotechnic charge, and specifically to effect initiation of the azide component of an automobile air bag.

Other designs are also possible, including one wherein the ignition charge and the enhancer charge are adjacent to one another within one container.

Control of the reaction rate of the prior art system is generally achieved by modification of the chemical formulation, such as the inclusion of inert materials in the mixture of the ignition charge or the enhancer charge, or by using non-optimum ratios (eg non-stoichiometric ratios of fuel to oxidizer) of reactants. The reaction rate can also be controlled through mechanical means such as by including a number of pressure release holes in the enhancer charge container.

While these prior art devices are currently in use, it would be desirable to provide a pyrotechnic composition which would be useful in providing an air bag having a reduced number of charges, and which pyrotechnic composition could be "time-controllable" while maintaining optimum reactant ratios and which avoids the use of unnecessary inert diluents.

SUMMARY OF THE INVENTION

Accordingly, the present invention provides a single charge pyrotechnic composition comprising about 5 to 55 percent by weight metal fuel, about 35 to 80 percent by weight oxidizer, and about 1 to 30 percent by weight of a secondary fuel.

This single charge pyrotechnic composition may be useful for squibs, igniters, delay composition for detonators, or in any use for which a pyrotechnic with variable output (eg heat/pressure) is found advantageous. Of particular importance, however, is that the compositions of the present invention may be substituted for the multiple charged igniter currently used for the air bag industry.

The metal fuel is preferably selected from the metals in the first, second and third transition series of the periodic table, and preferably is titanium, zirconium, magnesium, aluminum, hafnium, and chromium or combinations thereof and therebetween, and is most preferably titanium, zirconium or combinations thereof and/or therebetween.

The oxidizer may be any of a number of known oxidizers utilized in the explosives and/or pyrotechnic fields, but is preferably selected from alkali or alkali metal perchlorates, chlorates or nitrates, or other known oxidizers, and/or combinations thereof and/or therebetween. Preferably, the oxidizer is an alkali perchlorates, and most preferably, the oxidizer is potassium or sodium perchlorate, or a mixture of these two.

The secondary fuel is generally selected from nonmetallic fuels typically used in the explosives/pyrotechnics arts, and is preferably boron, silicon or carbon, or combinations thereof and/or therebetween. Most preferably, the secondary fuel is boron. The secondary reactant component is typically characterized in that its reaction rate with the oxidizer is slower than the reaction of the metal fuel with the oxidizer. Thus, the secondary reactant may be considered as a dilatory reactant in the composition of the present invention. However, the reaction of the secondary fuel generally provides more heat output, and burns longer than the reaction of the metal fuel.

The compositions of the present invention are preferably utilized to initiate the gas generant of an air bag system. This gas generant is typically an alkali azide material such as sodium azide. However, the compositions of the present invention may be utilized to initiate any compatible flame sensitive gas generating materials including propellants, pyrotechnic materials and/or explosives.

The formulation of the compositions of the present invention are preferably based on providing sufficient oxidizer for both the metal fuel and the secondary fuel in order to theoretically completely react with both fuels (i.e. the stoichiometric ratio). The theoretical reaction for a system comprising zirconium, boron and potassium perchlorate, can be calculated from the following reaction equations:

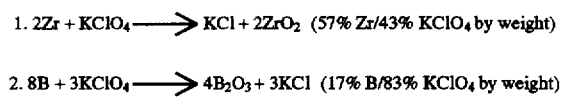

1. $2Zr + KClO_4 \longrightarrow KCl + 2ZrO_2$ (57% Zr/43% $KClO_4$ by weight)

2. $8B + 3KClO_4 \longrightarrow 4B_2O_3 + 3KCl$ (17% B/83% $KClO_4$ by weight)

Thus, the preferred compositions of the present invention can be considered as combinations of a stoichiometric mixture of a metal fuel/oxidizer component in combination with a stoichiometric mixture of a secondary fuel/oxidizer component. In practice, however, it may be desirable to provide compositions which are slightly fuel or oxidizer rich depending on the desired properties to be obtained. This is particularly true for control of gas output versus time and the compositions ability to properly ignite the propellant. Accordingly, the preferred compositions of the present invention have approximately stoichiometric mixtures of the metal fuel/oxidizer and the secondary fuel/oxidizer.

Combinations of the stoichiometric mixtures of metal fuel/oxidizer to secondary fuel/oxidizer can vary depending on the properties desired. The level of metal fuel/oxidizer mixture in the compositions can range from 1 to 99% metal fuel/oxidizer, preferably 20 to 90% metal fuel/oxidizer and more preferably 50 to 80% metal fuel/oxidizer. Most preferred is a mixture of from 60 to 75% metal fuel/oxidizer with 40 to 25% secondary fuel/oxidizer.

For example, a 60/40 mixture of metal fuel/oxidizer and secondary fuel/oxidizer for a zirconium, boron, and potassium perchlorate system would comprise approximately 34% by weight zirconium, 59% potassium perchlorate and 7% boron.

By controlling the ratio of the metal fuel/oxidizer to the second fuel/oxidizer, the reaction properties of the mixture can be adjusted. Accordingly, the reaction rate, the gas pressure output profile, the ability to properly ignite the propellant, and more generally the ballistic properties of the compositions of the present invention can be adjusted as desired for any given application.

Further, the sensitivity of the inventive compositions can be adjusted by controlling the ratio of the ingredients, by control of various parameters such as particle size, by providing additional oxidative coatings on the fuel and by controlling packing density of the compositions. Further, in use, the compositions are generally hard pressed into a specific shape which shape can also affect the ballistic and sensitivity properties of the composition.

In a further aspect, the present invention also provides an air bag igniter for initiation of an air bag gas generant comprising a single charge pyrotechnic composition as described hereinabove, operatively adjacent to a bridge wire, or any other suitable initiating source, so that initiation of said bridge wire will effect initiation of said pyrotechnic composition.

In an additional aspect, the present invention also provides an air bag propellant system comprising a gas generant operatively adjacent to an air bag igniter as described hereinabove, so that initiation of said air bag igniter will effect initiation of said gas generant.

Preferably, the gas generant utilized is an alkali azide, and in particular sodium azide.

By "operatively adjacent" is meant that the bridge wire is located close enough to the single charge pyrotechnic to effect initiation of the pyrotechnic when the bridge wire is initiated. This arrangement is standard practise in the detonator art. Similarly, the gas generant in an air bag is located close enough to the igniter to effect initiation of the gas generant as is well known in the air bag art.

DESCRIPTION OF THE PREFERRED EMBODIMENTS

A preferred formulation of the composition of the present invention, of use in an air bag application, comprises about 15 to 45% metal fuel, about 45 to 65% oxidizer and about 4 to 19% secondary fuel. A most preferred composition comprises about 25 to 40% metal fuel, about 50 to 60% oxidizer, and about 6 to 12% secondary fuel. (Unless otherwise stated, all compositions are based on a weight percentage basis.)

A most preferred composition according to the present invention comprises 35 to 37% zirconium, 6 to 8% boron, and 50 to 60% potassium perchlorate.

Measurement of the properties of each composition for the purposes of providing an effective pyrotechnic composition may be derived from pressure v. time curves. A family of curves may be generated by adjusting the amount of each component in any particular combination. The secondary fuel, in combination with the metal fuel and oxidizer may, as is shown in the examples section hereinbelow, retard a reaction which normally would combust within fractions of a millisecond to several milliseconds. This fine degree of reaction rate control is important in adjusting the pyrotechnic charge reaction properties to correspond to the desired heat transfer and sensitivity. As stated hereinabove, maintaining the desired heat transfer is also important in order to ensure that the gas generant charge of an air bag, by way of example, is timely initiated so as to fill the air bag within a desired time constraint. Further, while it is desirable to have a sensitive combination (sensitivity being a measure of the ease of ignition), too sensitive a combination may result in premature combustion.

It is preferred, however, that the pyrotechnic charge of the present invention should be sufficiently sensitive to be directly initiated by a bridge wire using conventional bridge wire technology. However, under certain situations, it may be desirable to provide an additional charge of a more sensitive material to aid in, or effect the initiation of the pyrotechnic material of the present invention. Also, while the present pyrotechnic material is preferably used to directly initiate the gas generant, the pyrotechnic charge of the present invention may be utilized to initiate other charges in a multi-charge pyrotechnic sequence.

Accordingly, the present invention also provides an air bag igniter for initiation of an air bag gas generant, comprising an initiating source such as a bridge wire initiator, a shock sensitive material which is ignited by the initiation of said initiating source, and a single charge pyrotechnic composition as described hereinabove with respect to the present invention, operatively adjacent to said shock sensitive material.

In this arrangement, the composition of the present invention acts primarily as the output charge from the igniter.

In its most general form the method of making the single charge pyrotechnic composition is to combine appropriately weighed portions of each component, combining the three component admixture in a wet blending technique. The admixture is air dried in a layer. The dried admixture is then screened to remove undesirable aggregates. The screened admixture is then packed in a pyrotechnic cup, or container, and pressed in-part by a press pin and then subsequently by the header of the igniter.

Additionally, a binding material or any other material to control the flow characteristics of the powder during pressing, such as Viton or any other material compatible with the admixture, may be added so that the admixture may be pressed into a solid mass.

The properties of the present invention will now be demonstrated by way of example only, by reference to the following examples.

EXAMPLES

In order to demonstrate the ability of formulations of the present invention in the control of reaction rate, a series of blends based on a zirconium, boron and potassium perchlorate system were prepared. An 800 mg sample of each mixture was placed inside of a 40 cc sealed "bomb" and initiated by passing a constant current pulse through a bridge wire. The pressure generated inside of the bomb was measured as a function of time.

The compositions tested had metal fuel/oxidizer to secondary fuel/oxidizer ratios of roughly 90/10, 60/40 and 10/90. The levels of each composition were slightly fuel rich and had the specific formulations set out in Table 1.

TABLE 1

| Metal Fuel/oxidizer to Sec. Fuel/oxidizer ratio | Zr (%) | B (%) | $KClO_4$ (%) |
|---|---|---|---|
| 90/10 | 54 | 2 | 44 |
| 60/40 | 36 | 7 | 37 |
| 10/90 | 6 | 18 | 72 |

The time/pressure profile for the three compositions are set out in the attached FIGURE.

In the FIGURE, it can be seen that the 90/10 and 60/40 compositions initiated rapidly (within 1 ms) and rapidly generated a relatively high pressure. The reactions for these two compositions were essentially complete within 3 ms as is evidenced by the decay in pressure resulting from cooling of the gases generated, or by slight leakage from the reaction bomb.

In contrast, the 10/90 composition was slower to initiate (6 ms) and reached a lower peak pressure. However, the reaction continued for at least the 15 ms shown in the FIGURE as is evidenced by the lack of decay in the time/pressure profile. Accordingly, this series of experiments demonstrates the use of compositions which can provide a rapid reaction rate having a high peak pressure output, and a slower reacting composition having a longer reaction time (and thus heat generation time).

Having described specific embodiments of the present invention, it will be understood that modifications thereof may be suggested to those skilled in the art, and it is intended to cover all such modifications as fall within the scope of the appended claims.

The embodiments of the invention in which an exclusive property or privilege is claimed are defined as follows:

1. A single charge pyrotechnic composition comprising (a) about 5 to 55 percent by weight metal fuel selected from titanium, zirconium, magnesium, aluminum, hafnium, and chromium or combinations thereof, (b) about 35 to 80 percent by weight oxidizer selected from an alkali or alkali metal perchlorate, chlorate or nitrate, or combinations thereof, and (c) about 1 to 30 percent by weight of a secondary fuel selected from boron, silicon or carbon, or combinations thereof.

2. An air bag igniter for initiation of an air bag gas generant comprising a single charge pyrotechnic composition as claimed in claim 1 operatively adjacent to an initiating source, so that initiation of said initiating source will effect initiation of said pyrotechnic composition.

3. A single charge pyrotechnic composition as claimed in claim 1 wherein said metal fuel is titanium, zirconium or combinations thereof.

4. An air bag igniter as claimed in claim 2 wherein said initiating source is a bridge wire initiator.

5. A single charge pyrotechnic composition as claimed in claim 1 wherein said oxidizer is an alkali perchlorate.

6. A single charge pyrotechnic composition as claimed in claim 5 wherein said alkali perchlorate is potassium or sodium perchlorate.

7. An air bag igniter for initiation of an air bag gas generant comprising an initiating source, a shock sensitive material which is ignited by the initiation of said initiating source, and a single charge pyrotechnic composition as claimed in claim 1 operatively adjacent to said shock sensitive material.

8. A single charge pyrotechnic composition as claimed in claim 1 wherein said secondary fuel is boron.

9. A single charge pyrotechnic composition as claimed in claim 1 comprising 15 to 45% of said metal fuel, 45 to 65% of said oxidizer, and 6 to 12% of said secondary fuel.

10. A single charge pyrotechnic composition as claimed in claim 9 comprising 25 to 40% of said metal fuel, 50 to 60% of said oxidizer, and 6 to 12% of said secondary fuel.

11. A single charge pyrotechnic composition as claimed in claim 1 comprising a combination of 50 to 75% of a stoichiometric mixture of said metal fuel and oxidizer, and 50 to 25% of a stoichiometric mixture of said secondary fuel and said oxidizer.

12. A single charge pyrotechnic composition as claimed in claim 1 comprising 35 to 37% zirconium, 6 to 8% boron, and 50 to 60% potassium perchlorate.

13. An air bag propellant system comprising a gas generant operatively adjacent to an air bag igniter as claimed in claim 2, so that initiation of said air bag igniter will effect initiation of said gas generant.

14. An air bag propellant system as claimed in claim 13 wherein said main propellant is an alkali azide.

15. An air bag propellant system as claimed in claim 14 wherein said main propellant is sodium azide.

16. An air bag propellant system consisting of a bridge wire igniter, a single charge pyrotechnic material as claimed in claim 1 operatively adjacent to said bridge wire igniter, and a gas generant operatively adjacent to said single charge pyrotechnic material.

* * * * *